US006301750B1

(12) United States Patent
Tsuzuki

(10) Patent No.: US 6,301,750 B1
(45) Date of Patent: Oct. 16, 2001

(54) SLIVER COMPRESSION METHOD AND DEVICE

(75) Inventor: Kiyohiro Tsuzuki, Greenville, SC (US)

(73) Assignee: Kiti International Corporation, Greenville, SC (US)

( * ) Notice: Subject to any disclaimer, the term of this patent is extended or adjusted under 35 U.S.C. 154(b) by 0 days.

(21) Appl. No.: 09/604,445

(22) Filed: Jun. 27, 2000

(30) Foreign Application Priority Data

Jun. 8, 1999 (JP) ..... 11-181049

(51) Int. Cl.[7] ..... D01B 3/04
(52) U.S. Cl. ..... 19/66 R; 28/285; 28/290
(58) Field of Search ..... 19/66 R, 66 CC, 19/150, 157, 159 A, 159 R; 28/167, 285, 290; 57/308, 90, 281

(56) References Cited

U.S. PATENT DOCUMENTS 1,629,167 * 5/1927 Krantz ..... 28/285
2,127,638 * 8/1938 Brandwood ..... 28/167
2,139,543 * 12/1938 Finlayson et al. ..... 19/66 R
3,849,848 * 11/1974 Umehara et al. ..... 28/167
3,879,965 * 4/1975 Champel et al. ..... 68/5
4,590,683 * 5/1986 Magin ..... 34/1
4,667,373 * 5/1987 Roder ..... 19/66 R
4,862,559 * 9/1989 Roder et al. ..... 19/66 R
5,269,052 * 12/1993 Tsuzuki ..... 28/285
5,423,109 * 6/1995 Tsuzuki ..... 28/285

* cited by examiner

*Primary Examiner*—John J. Calvert
*Assistant Examiner*—Gary L. Welch
(74) *Attorney, Agent, or Firm*—John B. Hardaway, III; Hardaway/Mann IP Group

(57) ABSTRACT

This invention relates to a silver compression method and device. By using the compression method of this invention, the loaded sliver is reduced without requiring the use of spindles and thus allow for easier handling in the next process.

1 Claim, 9 Drawing Sheets

SLIVER COMPRESSION METHOD AND DEVICE

FIELD OF THE INVENTION

This invention relates generally to the art of sliver compression methods and devices. It allows sliver to be freely loaded onto a plate without having restrictions around the entire circumference of the sliver that is loaded onto the plate where the sliver will then be compressed. This invention relates to the compression method of sliver and how it is loaded on the plate-like sliver tray without restrictions on the entire circumference of the loaded sliver.

BACKGROUND OF THE INVENTION

The common industrial method currently in use is to take sliver spun out of the drawing frame and to place it on a tube-like spindle with a bottom. This patent applicant has previously applied for patents by developing the accommodation method which allows for accommodating the spun out sliver onto a plate-like sliver tray instead of using spindles (Japanese Patent Application 11-54930 and Japanese Patent Application 11-99550). When using the conventional spindle method, the accommodated sliver will be compressed to reduce the entire volume because the external circumference of accommodated sliver is in contact with the internal circumference of the spindle with a designated pressure.

The previously applied for patent methods occurred without using a spindle and created a non-restricting condition on the entire external circumference. The previously applied for new methods did not help prevent the sliver (which consists of fibers) from reversing back to their original shape as shown in FIG. 8 and FIG. 9. The loaded sliver $S_1$ which was spun out onto the square plate-like tray $T_1$ in FIG. 8 was accumulated in a truncated quadrangular shape, and the sliver $S_2$ in FIG. 9 was then accumulated into the shape of a truncated cone. As a result, $S_1$ and $S_2$, each then accumulated on $T_1$ and $T_2$, both had a low density and a high volume and without adequate control both were unstable. These factors can cause various troubles including the possibility of collapse while transporting the loaded sliver to the next process. In addition, the previous methods required a large storage space in which to store the spindles.

SUMMARY OF THE INVENTION

This invention presents a new method and device of compressing loaded sliver onto a plate-like sliver tray after being accommodated by the non-spindle method to reduce the volume for easier handling in preparation for the next process.

Explanations of symbols used in the figures of drawing:

B: Compression box
- $S_1$, $S_2$: Loaded sliver
- $T_1$, $T_2$: Sliver tray
- 7: Bottom plate of the compression box
- 8: Compression panel
- 12: Exhaust pipe
- 13: Vacuum pump
- 14: Chamber of compression box
- 17: Steam holes (sliver tray)
- 18: Steam holes (bottom panel of compression box)

DETAILED DESCRIPTION

This sliver compression method has a special characteristic of having two types of processes. One process is the compressing process which occurs by pressing the loaded sliver from above while vacuuming the air out of the compression box in which the loaded sliver is accommodated, and the second process is the steaming process which is accomplished by blowing the steam onto the loaded sliver after the sliver has been compressed.

The sliver compression device compresses the sliver loaded freely without restrictions on the plate-like sliver tray. This device consists of a compression box to store the above mentioned loaded sliver, a pressing mechanism to compress the loaded sliver from above, and a steam blower to blow steam onto the loaded sliver while retaining the loaded sliver's stable and compressed condition.

This device is equipped with steam holes on the sliver tray and has a special characteristic that allows steam to be blown onto the loaded sliver from the bottom panel through the aforementioned steam holes.

This invention has the following characteristic(s): Compressing loaded sliver accommodated (in a non-restricted condition) on the entire external circumference to solve the above mentioned problem. It has two processes; the compression process from above occurs while at the same time vacuuming the compression box in which the sliver is accommodated, and second the steaming process which blows steam onto the loaded sliver while retaining the compression.

When vacuuming the compression box in which the loaded sliver is accommodated, the air in the fiber of the loaded sliver and the air inside the chamber of the compression box will be extracted. By this process, extracting the air inside the loaded sliver, the sliver's overall volume will be reduced. While this vacuuming of air occurs, the inside of the compression box remains close to airtight, and the loaded sliver will be compressed from above to reduce its volume. Then steam will be blown onto the loaded sliver.

Once the loaded sliver is compressed and shaped to reduce the volume inside the airtight box, then high temperature steam will be blown onto the loaded sliver. The steam will reach every fiber of the sliver and the moisture will penetrate the fibers enabling the fibers to retain the shape of the compressed sliver. This process will provide both the necessary moisture needed for the next process and also maintain a high density in the sliver.

Figure 1:
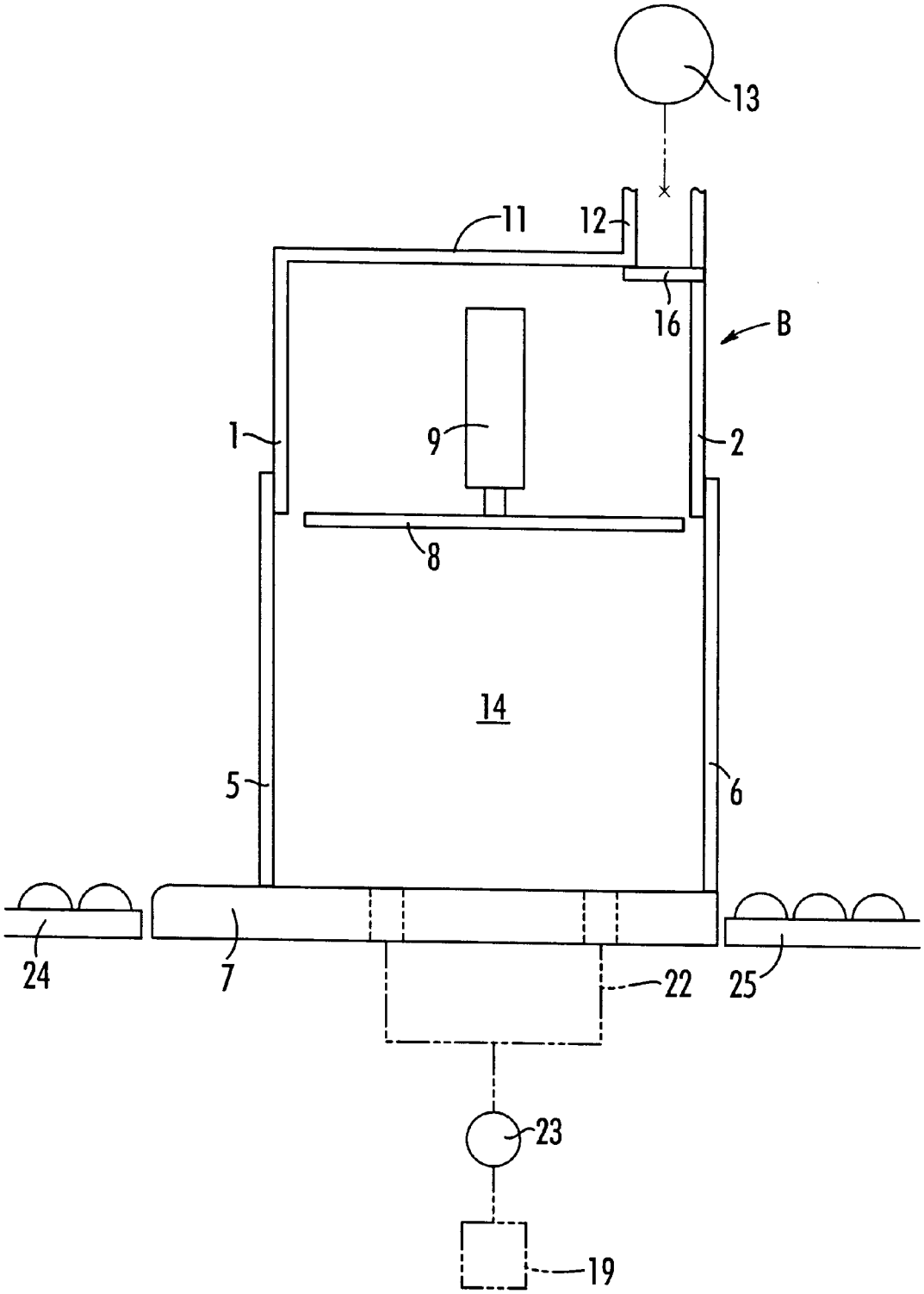
FIG. 1 is a front view of the sliver compression device.
Figure 7:
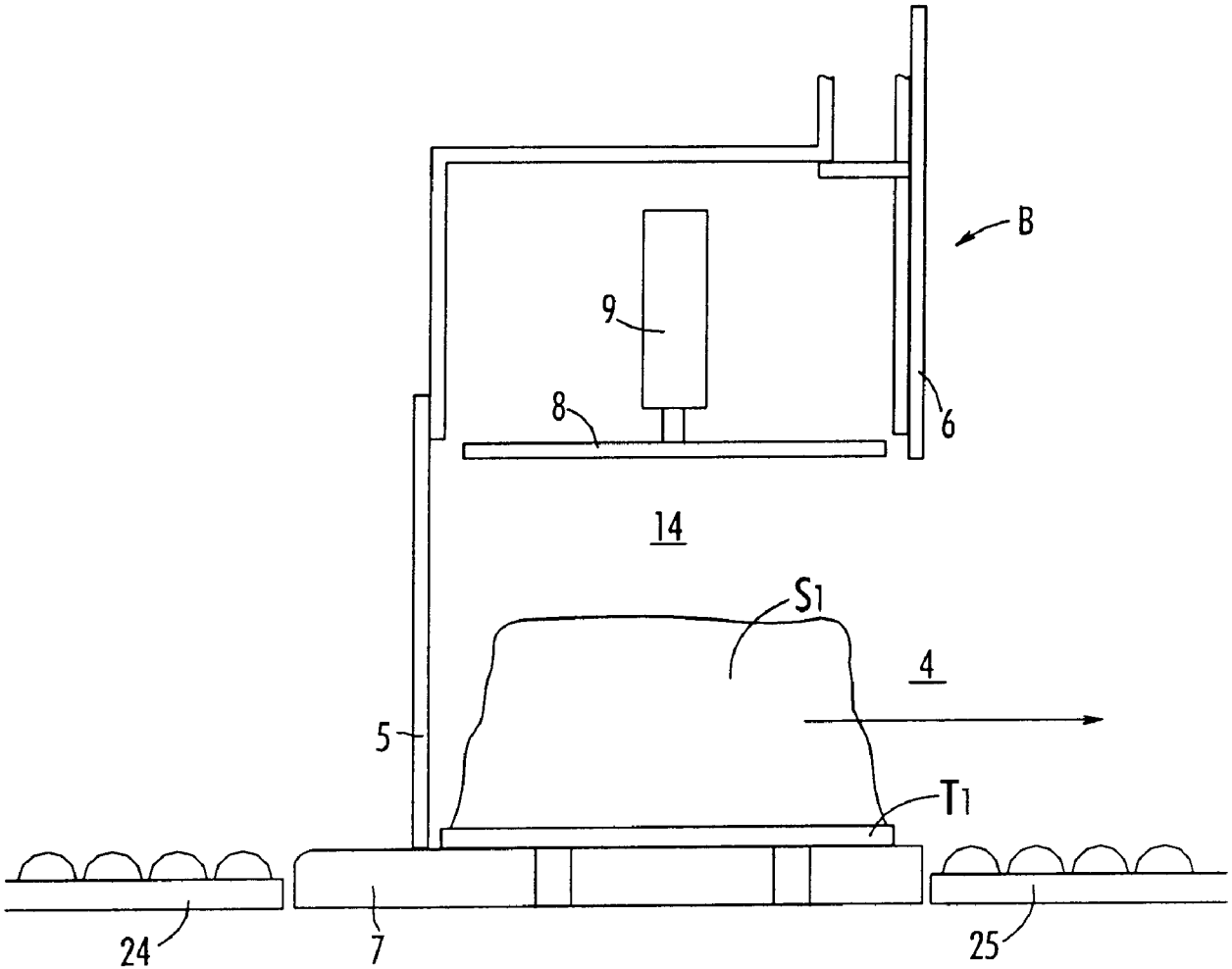
FIG. 7 illustrates loaded sliver $S_1$ being compressed, formed, and carried out of the chamber.
Figure 8:
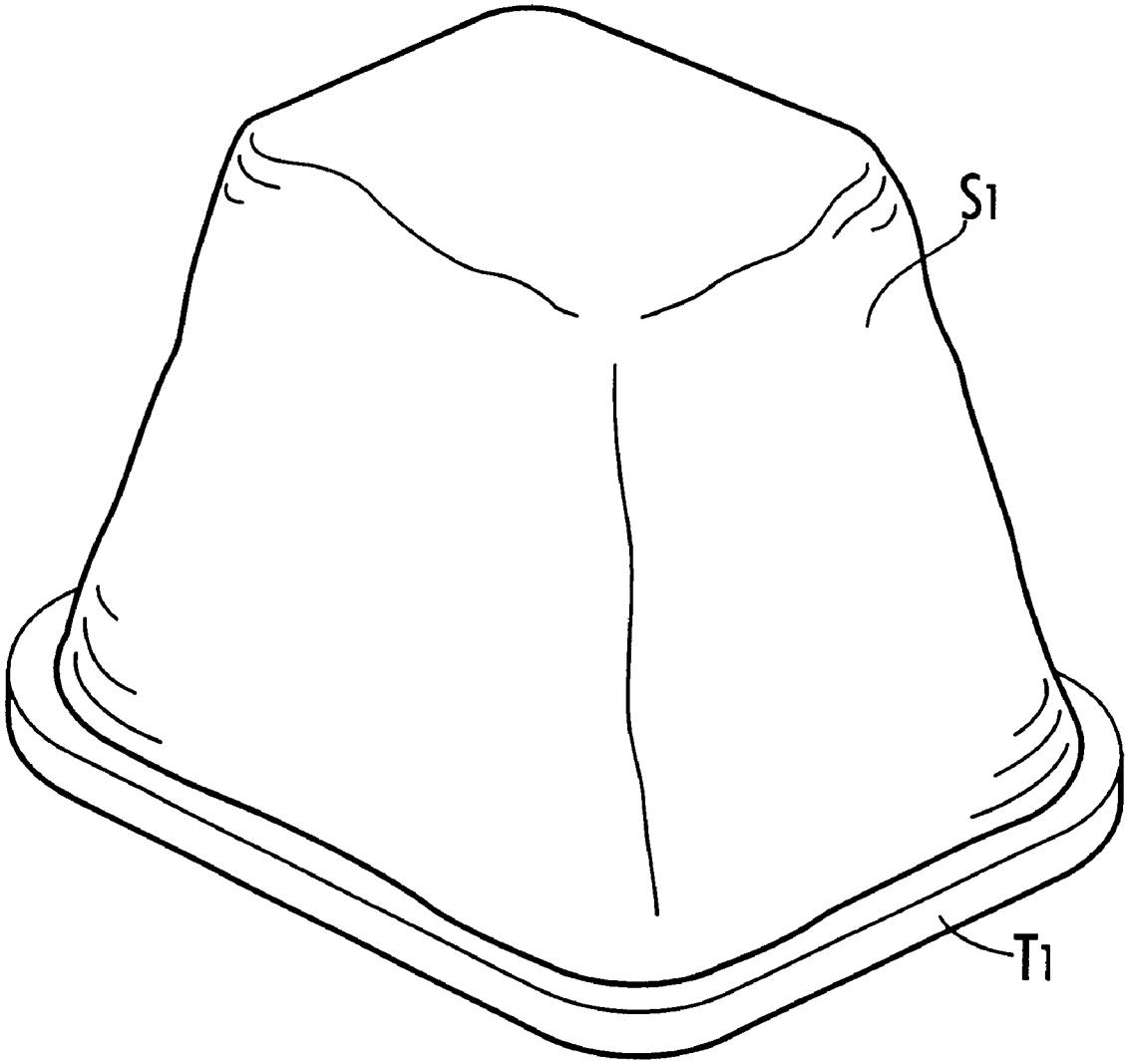
FIG. 8 is an oblique drawing of the loaded sliver $S_1$.
Figure 9:
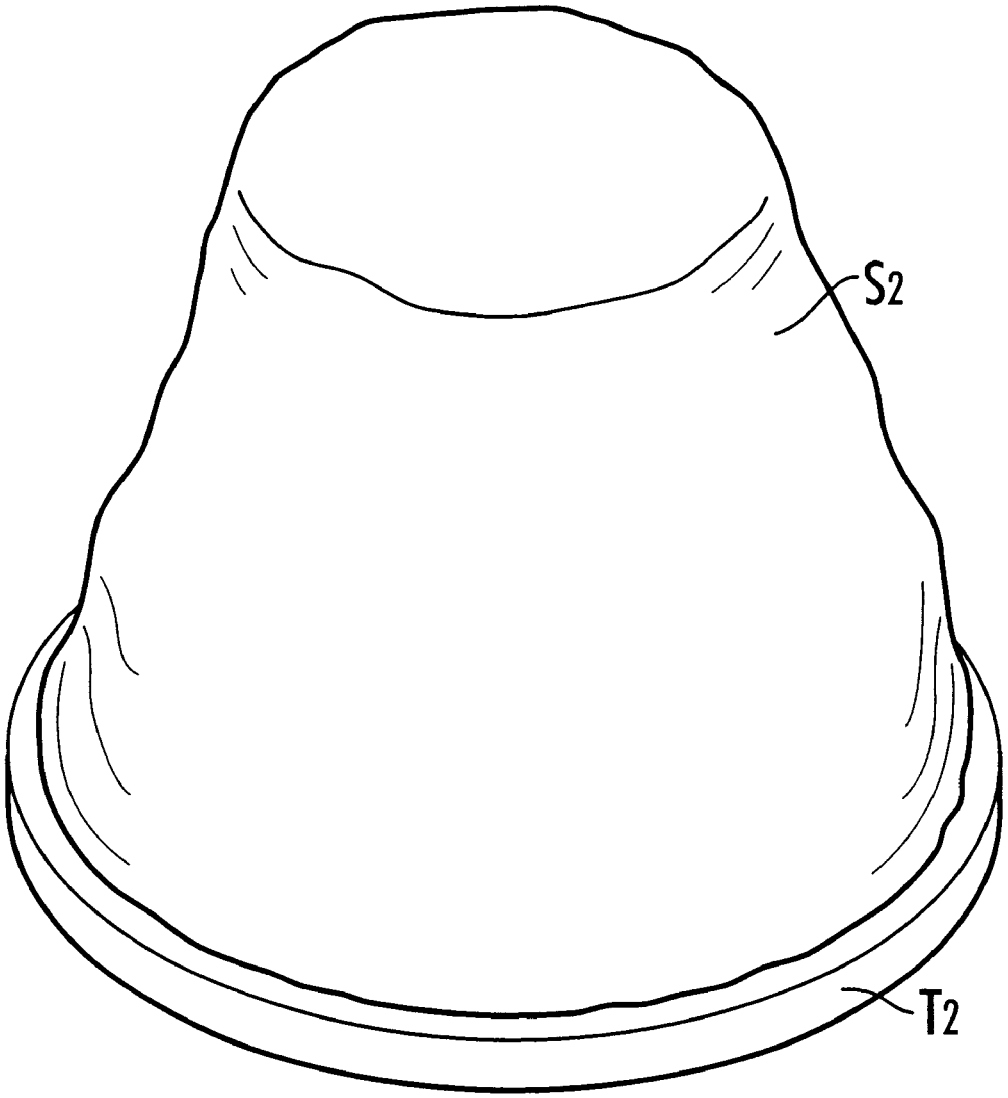
FIG. 9 is an oblique drawing of the loaded sliver $S_1$.

The following is a detailed description of the invention by showing the attached examples. First, the structure of sliver compression device of this invention, and then each individual process of compressing sliver S1 on the sliver tray T2 using this device will be explained. FIG. 1 is a front view of the sliver compression device. Compression box B in FIG. 1 is airtight and has both an entrance 3 (see FIG. 3) and an exit 4 (see FIG. 7) with side panels designated as side panel 1 and side panel 2. There are two doors which move upward and downward, they are designated as door 5 and door 6, and these doors are located outside of each side panel. A bottom panel 7 is installed at the bottom of the box B for the loaded sliver S1 to be transferred onto.

A compressing board 8 is installed to both lift and/or lower the inside of the box B so that the loaded sliver $S_1$, which was transferred to the bottom panel 7 as mentioned above, will be compressed from upward by the action of the cylinder 9. An exhaust air pipe 12 is connected to the top panel 11 of the box B to let the air inside of box B out and an exhaust air pipe 12 is connected to the vacuum pump 13. Between the exhaust air pipe 12 and the chamber 14 inside of the box B, a shutter 16 is installed to maintain the vacuum condition inside the chamber 14.

Figure 2:
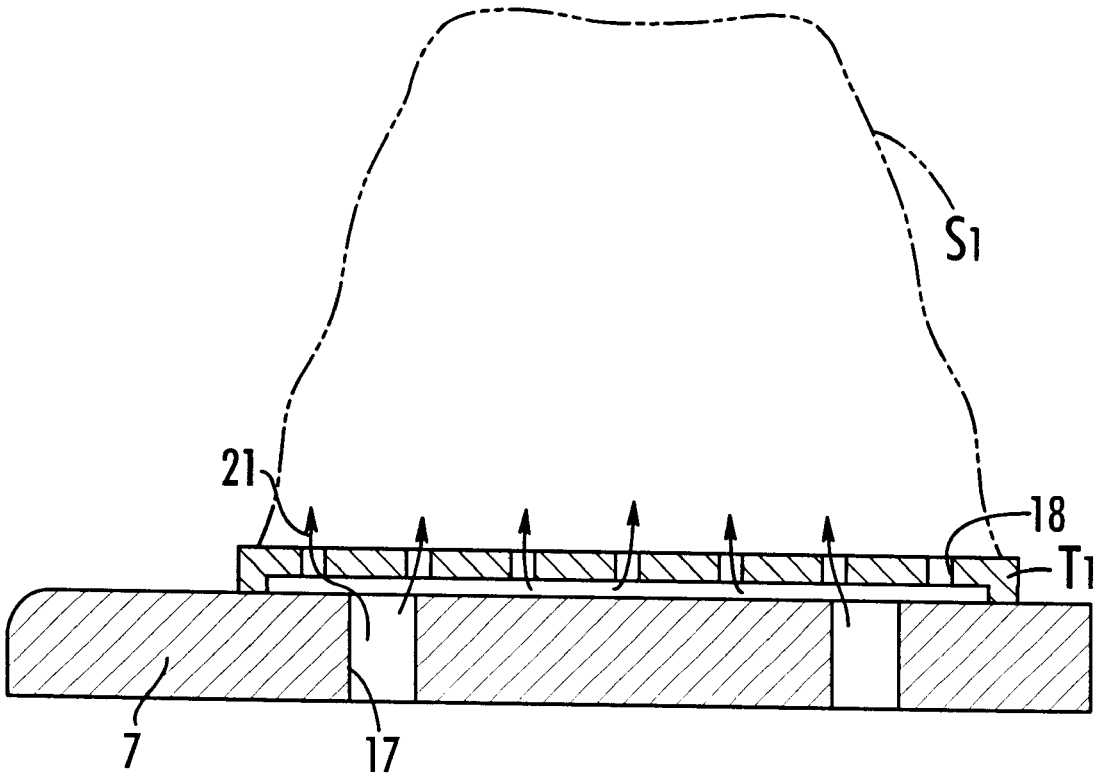
FIG. 2 is a cross-section of a loaded sliver on a sliver tray resting on a compression panel.

Also, as shown in FIG. 2, a square plate-like sliver tray $T_1$ is below and located beneath the entire sliver area except for its outer edges, and steam holes 17. The bottom panel 7 of the box B, where the sliver tray $T_1$ will be loaded, also has a number of steam holes 18 from the top to the bottom. The steam 21 coming out of steam source 19 will go through a steam pipe 22 and will be supplied to the steam holes 18. Number 23 in FIG. 1 shows an opening/closing valve on the steam pipe 22.

A conveyor 24 brings in the sliver and another conveyor 25 carries out the sliver and these conveyers are installed at both the entrance and the exit of the compression box B. Both conveyors 24 and 25 are roller conveyors and the height of the rollers is approximately the same height as the bottom panel 7 of the compression box B so that the loaded sliver $S_1$ can be easily brought into and carried out of the aforementioned compression box B.

Figure 3:
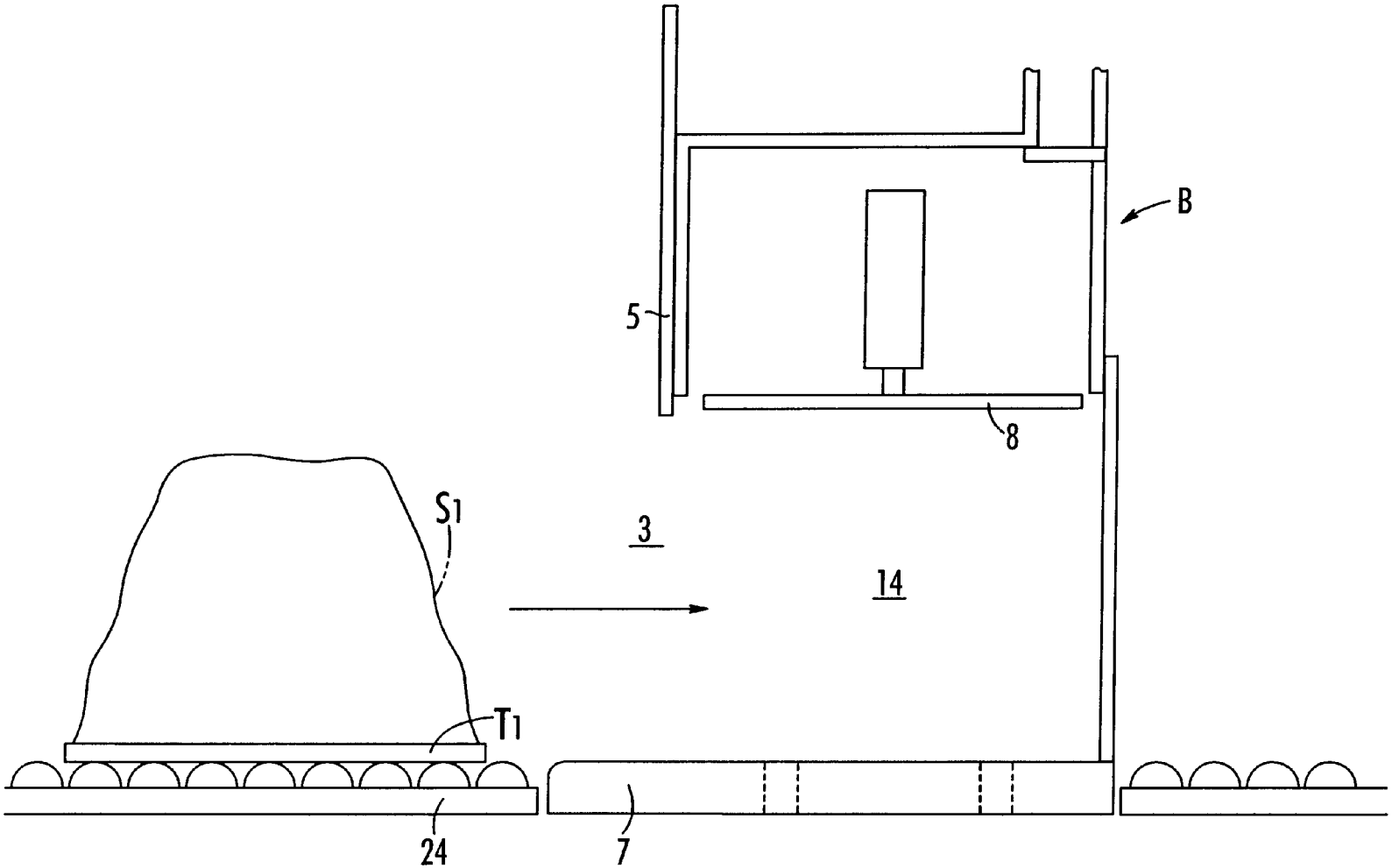
FIG. 3 illustrates loaded sliver $S_1$ being transferred into compression box B.
Figure 4:
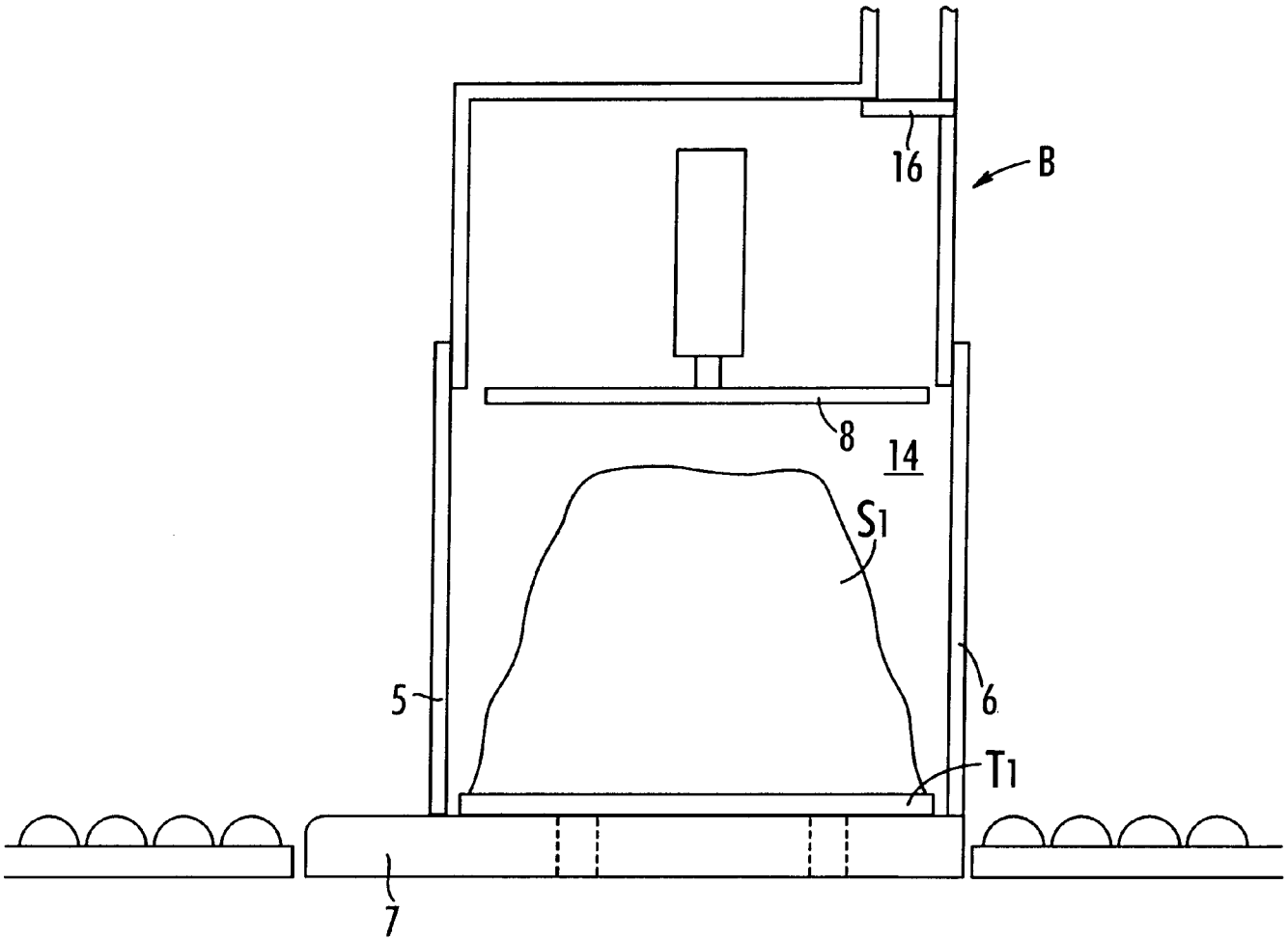
FIG. 4 illustrates loaded sliver $S_1$ having been transferred into compression box B.

Each process of how the loaded sliver $S_1$ is compressed by the above mentioned device A can be explained as follows. As shown in FIG. 3, while the door 5 is raised to keep the entrance 3 to the chamber 14 open, the loaded sliver $S_1$ will be transferred to the chamber 14 from the conveyor 24. After this transfer is complete, the door 5 will be lowered to close the entrance 3.(See FIG. 4.)

Figure 5:
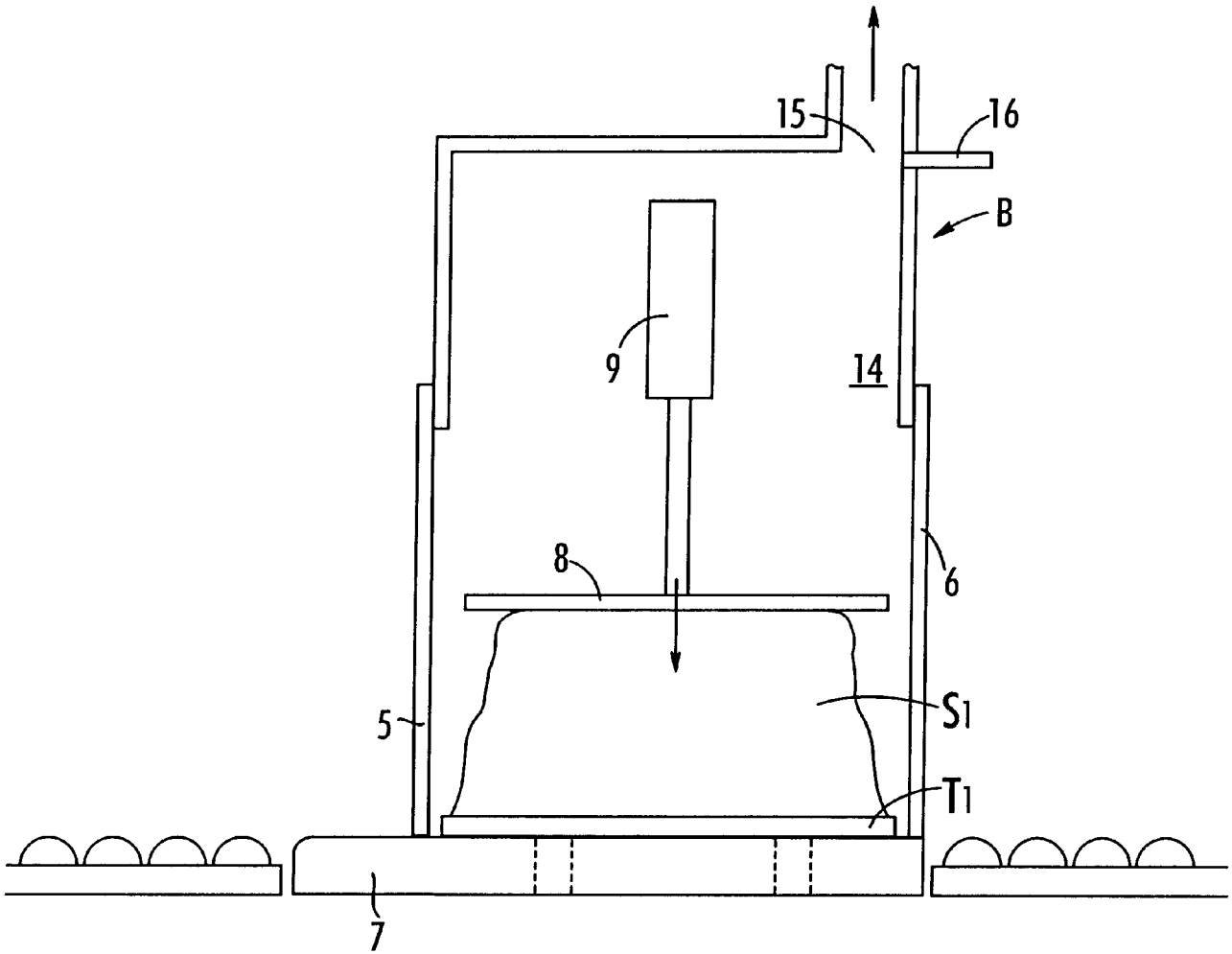
FIG. 5 illustrates chamber 14 inside compression box B being vacuumed.

Next, the shutter 16, which closes the exhaust pipe 15, will be opened so that the chamber 14 in the compression box B will have a clear path to let the air out by means of the operation of the vacuum pump 13. At the same time, the cylinder 9 will lower the compressor board 8 gradually to compress the loaded sliver $S_1$ from above. (See FIG. 5.) During this procedure, because part of the air held inside the loaded sliver $S_1$ will be released into the chamber 14 and because the air inside of the chamber 14 in box B will be vacuumed, the chamber 14 will become close to a vacuum condition.

Figure 6:
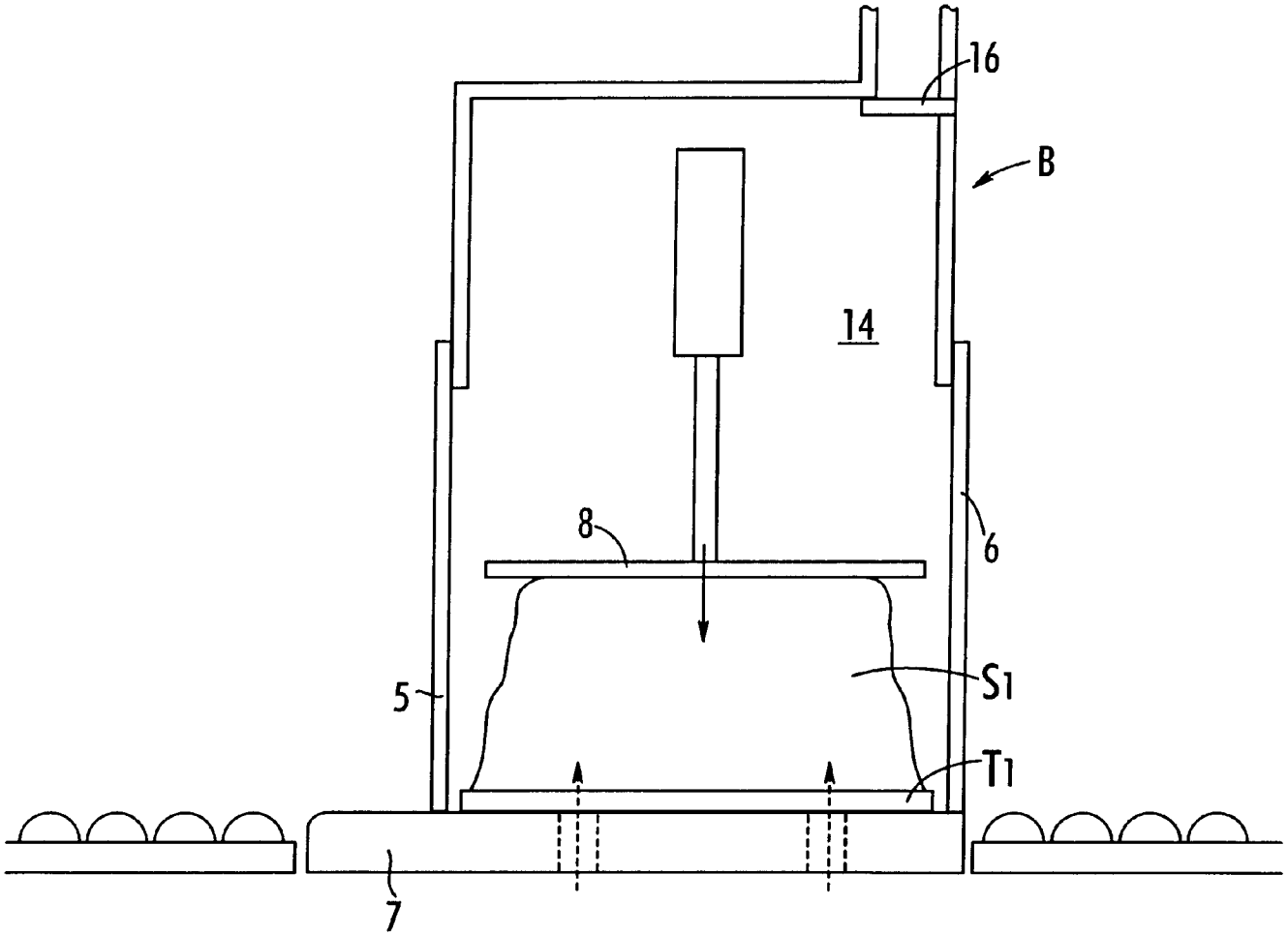
FIG. 6 illustrates the loaded sliver in compression box B being compressed while the steam is also being blown onto it.

After the above mentioned procedures have occurred, the shutter 16 above the compression box B will close the exhaust pipe 15 and maintain the chamber 14 at close-to-vacuum condition (See FIG. 6.). By maintaining the chamber 14 at close to vacuum condition, and by opening the opening/closing valve 23 for the steamer (steam source) 19, and allowing the steam from the steamer 19 to go through the steam pipe 22 to reach the steam holes 18 on the bottom panel 7 of the compression box B, steam will then go through the steam holes 17 on the sliver tray $T_1$ and will be blown inside the compression box onto the loaded sliver $S_1$. (See FIG. 6.)

Each fiber of the accumulated sliver SI, which is compressed to keep the volume down in the close-to-vacuum condition inside the compression box B, will be thoroughly exposed directly to high temperature steam. The steam moisture will penetrate through the sliver fiber and the compulsory form made by the aforementioned compression will retain its shape by steam heat setting effect. The steam will be used to set and compress the sliver into a fixed stable form. This is the same mechanism by which the steam will further stabilize the strand(s) of yam. The effect of this steam stabilization is the same effect as if ironing the fabric flat. Due to close-to-vacuum condition inside of the chamber 14 the steam blown into the chamber from the bottom of the loaded sliver S1 will penetrate the sliver S1, and forcibly shape the entire loaded sliver $S_1$ into a smaller compressed shape.

Raise the compression board 8 and raise the shutter 6 on the exit side of compression box B at the same time to let the formed and compressed loaded sliver $S_1$ out of chamber 14 and onto the conveyor 25. (See FIG. 7.) By repeating each process mentioned above, the loaded sliver on the sliver tray sitting freely without restrictions on its entire circumference will be continuously compressed and formed. Also, the loaded sliver in the conical truncated shape on the sliver tray $T_2$ will be compressed and formed in the same manner.

This invention allows sliver, loaded and sitting freely without restrictions around it on the sliver tray, to be compressed in the vacuum compression box, and then to be shaped by blowing steam inside onto the sliver to achieve a steam setting on the fibers (which the sliver consists of). A low density sliver pile that contains high amounts of air will be reduced by vacuuming and will be turned into a high density sliver pile and the part of the moisture included in the steam will penetrate through the entire high density sliver pile.

This will result in the loaded sliver not only eliminating a risk of collapsing during the transportation to the next process, but also preventing various other problems from occurring. It should reduce the required space needed to store the loaded sliver. It would also supply a part of the moisture in the sliver fiber required for the next process.

Here is an example. There is a 3-storied factory with the spinning room on the $1^{st}$ floor and the sliver rooms on $2^{nd}$ and $3^{rd}$ floors. The sliver in the upper floored sliver room is supplied through the resin tube to the spinning machine installed in the spinning room on the $1^{st}$ floor. This system does not require roving and has an advantage of having a capability of air conditioning each room separately. In the past the sliver usually requires a designated time to be humidified in the humidifying silver room, A manufacturer by employing this invention can reduce the processing time required because the moisture in the steam will be supplied to the sliver during the process when the steam is being blown onto the sliver.

The invention as disclosed herein is subject to various modifications and variations as will be seen by those of ordinary skill in the art. The invention is therefore not limited solely to the method and apparatus specifically described, but is intended to have the scope as set forth in the following claims.

What is claimed is:

1. An apparatus for sliver treatment, comprising:

a compression box having an entrance and an exit;

a door for said entrance;

a door for said exit;

a conveyor for conveying sliver on a platform into said compression box through said entrance;

a conveyor for removing sliver from said compression box through said exit;

a bottom panel above which said compression box is positioned;

an orifice through said compression box through which a vacuum can be applied to said compression box;

a closure for said orifice;

an orifice through said platform for the injection of steam;

a compression plate within said compression box for compressing said sliver;

a transporting tray on which said sliver is transported from conveyor to compression box to conveyor, whereby said sliver is transported on said tray from a conveyor through an entrance to said compression box, said entrance and exit are closed to permit the imposition of a vacuum through the orifice of said compression box and closed by said closure to retain said vacuum, said compression plate compresses said sliver onto said tray, said tray having orifices there through for communication with said orifices of said bottom panel, then steam is injected through the orifices of said bottom panel and through the orifices of said tray to substantially moisturize said sliver whereupon said closure is opened, said exit door is opened, and said sliver on said tray is removed from said compression box on the conveyor in communication with said exit.

* * * * *